US005993730A

United States Patent [19]

Waldenström et al.

[11] Patent Number: 5,993,730

[45] Date of Patent: Nov. 30, 1999

[54] METHOD OF MAKING METAL COMPOSITE MATERIALS

[75] Inventors: Mats Waldenström, Bromma; Rolf Svensson, Hägersten, both of Sweden

[73] Assignee: Sandvik AB, Sandviken, Sweden

[21] Appl. No.: 09/169,952

[22] Filed: Oct. 13, 1998

[30] Foreign Application Priority Data

Oct. 14, 1997 [SE] Sweden ..... 9703738

[51] Int. Cl.[6] ..... B22F 1/02; B22F 3/12

[52] U.S. Cl. ..... 419/14; 419/15; 419/17; 419/18; 419/38; 419/57; 419/58; 419/59

[58] Field of Search ..... 419/14, 15, 17, 419/18, 38, 57, 58, 59

[56] References Cited

U.S. PATENT DOCUMENTS

| | | | |
|---|---|---|---|
| 4,498,395 | 2/1985 | Kock et al. | 102/517 |
| 4,770,907 | 9/1988 | Kimura | 427/217 |
| 4,818,567 | 4/1989 | Kemp, Jr. et al. | 427/216 |
| 4,975,333 | 12/1990 | Johnson et al. | 428/570 |
| 5,505,902 | 4/1996 | Fischer et al. | 419/10 |

*Primary Examiner*—Daniel J. Jenkins

*Attorney, Agent, or Firm*—Burns, Doane, Swecker & Mathis, L.L.P.

[57] ABSTRACT

One or more organic or inorganic metal salts or compounds of at least one of the groups IV, V and VI of the periodic system, particularly V, Cr, Mo and W, optionally together with one or more organic iron group metal salts, are dissolved in at least one polar solvent and complex bound with at least one complex former comprising functional groups in the form of OH or $NR_3$, (R=H or alkyl). Hard constituent powder and optionally soluble carbon source are added to the solution. The solvent is evaporated and the remaining powder is heat treated in an inert and/or reducing atmosphere. As a result, coated hard constituent powder is obtained, which after addition of a pressing agent and optionally with other coated hard constituent powders and/or carbon to obtain the desired composition, can be compacted and sintered according to standard practice.

16 Claims, 1 Drawing Sheet

METHOD OF MAKING METAL COMPOSITE MATERIALS

BACKGROUND OF THE INVENTION

The present invention relates to a method of producing metal composite materials such as cemented carbide.

U.S. Pat. No. 5,505,902 discloses a method in which one or more metal salts of at least one iron group metal containing organic groups are dissolved in at least one polar solvent such as ethanol, methanol and water, and complex bound with at least one complex former comprising functional groups in the form of OH or $NR_3$ (R=H or alkyl). Hard constituent powder and, optionally, a soluble carbon source are added to the solution. The solvent is evaporated and the remaining powder is heat treated in inert and/or reducing atmosphere. As a result, a hard constituent powder coated with at least one iron group metal is obtained, which after the addition of a pressing agent, can be compacted and sintered according to standard practice to form a body containing hard constituents in a binder phase.

When making submicron cemented carbide, i.e., with a WC grain size of <1 $\mu$m, grain growth inhibitors have to be added in order to avoid WC grain growth during sintering. Examples of such grain growth inhibitors are VC, $Cr_3C_2$. The above mentioned patent discloses a method of depositing a layer of binder metal onto the surfaces of the hard constituent grains. It is, however, desirable to also be able to precipitate at the same time, the elements inhibiting grain growth.

OBJECTS AND SUMMARY OF THE INVENTION

It is an object of this invention to avoid or alleviate the problems of the prior art.

It is further an object of this invention to provide a method of precipitating the metals of groups IV, V and VI of the periodic system particularly V, Cr, Mo and W.

In one aspect of the invention there is provided a method of making a metal composite material comprising the following steps:

forming a solution by dissolving at least one salt of at least one metal salt or compound of at least one of the groups IV, V and VI of the periodic system in at least one polar solvent and complex binding said salt with at least one complex former comprising functional groups in the form of OH or $NR_3$, wherein R=H or alkyl;

adding hard constituent powder to the solution;

forming a powder mixture by evaporating the solvent;

heat treating the powder mixture in an atmosphere until the hard constituent powder is coated with said at least one metal, said atmosphere being selected from the group consisting of inert atmospheres, reducing atmospheres and mixtures thereof.

DETAILED DESCRIPTION OF THE PREFERRED EMBODIMENTS OF THE INVENTION

Figure 1:
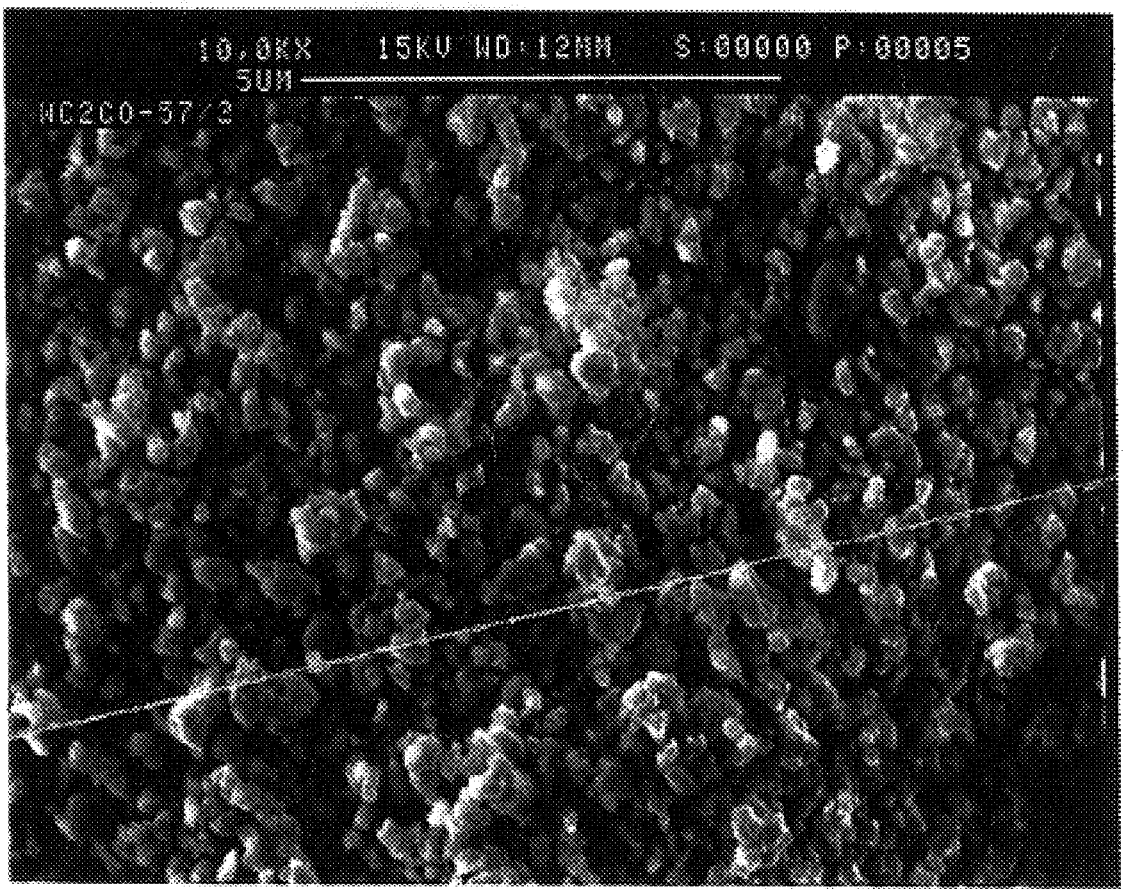
FIG. 1 shows at 10000× the microstructure of the coated hard constituent powder according to the invention.

It has now surprisingly been found that a method similar to that disclosed in the above mentioned U.S. Pat. No. 5,505,902 can be used with the precipitation of the metals of groups IV, V and VI of the periodic system, particularly V, Cr, Mo and W. The technique of U.S. Pat. No. 5,505,902, mentioned above, while similar, relates only to the use of an iron group metal as the coating material and then only with the iron group metal used as the organic salt. The metals used in the present invention are strong carbide formers and are preferably used as the inorganic salt.

According to the method of the present invention, one or more organic or inorganic metal salts or compounds of at least one of the groups IV, V and VI of the periodic system, particularly V, Cr, Mo and W, optionally together with one or more organic iron group metal salt, are dissolved in at least one polar solvent such as ethanol, methanol and water and complex bound with at least one complex former comprising functional groups in the form of OH or $NR_3$, (where R=H or alkyl). Hard constituent powder and optionally, a soluble carbon source, are added to the solution. The solvent is evaporated and the remaining powder is heat treated in an inert and/or reducing atmosphere. As a result, a coated hard constituent powder is obtained which, after addition of a pressing agent alone or optionally with other coated hard constituent powders and/or binder phase metals, can be compacted and sintered according to standard practice.

The process according to the invention, comprises the following steps where Me=Metals of groups IV, V and VI of the periodic system, preferably V, Cr, Mo, W and most preferably, V and Cr:

1. At least one Me-salt or compound containing organic or preferably inorganic groups, optionally combined with an addition of one or more organic iron group metal salt, is dissolved in at least one polar solvent such as ethanol, methanol, water, acetonitrile, dimethylformamide of dimethylsulfoxide and combinations of a solvent such as methanol-ethanol and water-glycol, preferably methanol and/or water. Triethanolamine or other complex former, especially molecules containing more than two functional groups, i.e., OH or $NR_3$ with (R=H or alkyl), 0.1–2.0 mole complex former/mole metal, preferably about 0.5 mole complex former/mole metal is added under stirring.

2. Optionally, sugar ($C_{12}H_{22}O_{11}$) or other soluble carbon sources such as other types of carbohydrates and/or organic compounds, which decompose under formation of carbon in the temperature range 100°–500° C. in a nonoxidizing atmosphere can be added (<2.0 mole C/mole metal, preferably about 0.5 mole C/mole metal). The solution is heated to 40° C. in order to improve the solubility of the carbon source. The carbon is used to reduce the MeO formed in connection with heat treatment and to regulate the C-content in the final product.

3. A hard constituent powder such as WC, (Ti,W)C, (Ta,Nb)C, (Ti,Ta,Nb)C, (Ti,W)(C,N), preferably well-deagglomerated, e.g., by jet milling, is added under moderate stirring and the temperature is increased to accelerate the evaporation of the solvent. When the mixture has become rather viscous, the dough-like mixture is kneaded and when almost dry, smoothly crushed in order to facilitate the evaporation (avoiding inclusions of solvent).

4. The loosened powder lump obtained in the preceding step is heat treated in nitrogen and/or hydrogen at about 400°–1100° C., preferably 400°–800° C. To achieve a fully reduced powder, a holding temperature might be needed. The time of heat treatment is influenced by process factors such as powder bed thickness, batch size, gas composition and heat treatment temperature and has to be determined by experiments. A holding time for reduction of a 5 kg powder batch in a pure hydrogen atmosphere at 650° C. of 60–120 minutes has been found suitable. Nitrogen and/or hydrogen is normally used but Ar, $NH_3$, CO and $CO_2$ (or mixtures thereof) can be used whereby the composition and microstructure of the coating can be modulated.

5. After the heat treatment, the coated powder is mixed with a pressing agent in ethanol to form a slurry either alone or with other coated hard constituent powders and/or binder phase metals and/or carbon to obtain the desired composition. The slurry is then dried, compacted and sintered in the usual way to obtain a sintered body of hard constituents in a binder phase.

Most of the solvent can be recovered which is of great importance when scaling up to industrial production.

Alternatively, the pressing agent can be added together with the hard constituent powder according to paragraph 3, directly dried, pressed and sintered.

The invention is additionally illustrated in connection with the following Examples which are to be considered as illustrative of the present invention. It should be understood, however, that the invention is not limited to the specific details of the Examples.

EXAMPLE 1

A WC—10% Co—0.4% $Cr_3C_2$—0.3% VC cemented carbide was made in the following way according to the invention: 23 g chromium (III) nitrate-9-hydrate ($Cr(NO_3)_3 \times 9H_2O$) and 3.6 g ammonium vanadate ($NH_4VO_3$) was dissolved in 1700 ml methanol ($CH_3OH$). 297.5 g cobalt acetate tetrahydrate ($Co(C_2H_3O_2)_2 \times 4H_2O$) was added to the solution. To this solution, 105 g triethanolamine ($(C_2H_5O)_3N$ was added during stirring. After that, 686 g WC ($d_{WC}$=0.6 $\mu$m) was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous bed about 1 cm thick in nitrogen atmosphere in a closed vessel, with the heating rate of 10° C./min to 550° C., completed with reduction in hydrogen for 90 minutes, finally followed by cooling in a nitrogen atmosphere at 10° C./min. No cooling step between the burning off and the reduction step was used. FIG. 1 shows the microstructure of the coated hard constituent powder at 10000×.

The powder obtained was mixed with a pressing agent in ethanol with adjustment of carbon content (carbon black), dried, compacted and sintered according to standard practice for WC—Co alloys. A dense cemented carbide structure was obtained with porosity A00 and hardness HV3=1730.

EXAMPLE 2

A WC—10% Co—0.4% $Cr_3C_2$—0.3% VC cemented carbide was made in the following way according to the invention: 13.4 g chromium (III) nitrate-9-hydrate ($Cr(NO_3)_3 \times 9H_2O$) and 2.1 g ammonium vanadate ($NH_4VO_3$) was dissolved in 700 ml methanol ($CH_3OH$). To this solution, 12.2 g triethanolamine ($(C_2H_5O)_3N$ was added during stirring. After that, 400 g WC ($d_{WC}$=0.6 $\mu$m) was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous be about 1 cm thick in nitrogen atmosphere in a closed vessel, with the heating rate of 10° C./min to 600° C., completed with reduction in hydrogen for 90 minutes, finally followed by cooling in nitrogen atmosphere at 10° C./min. No cooling step between the burning off and the reduction step was used.

The powder obtained was mixed with a pressing agent and Co-binder (Co-powder extra fine) in ethanol and adjustment of carbon content (carbon black), dried, compacted and sintered according to standard practice for WC—Co alloys. A dense cemented carbide structure was obtained with porosity A00 and hardness HV3=1700.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a metal composite material comprising the following steps:

forming a solution by dissolving at least one salt of at least one metal salt or compound of at least one of the groups IV, V and VI of the periodic system in at least one polar solvent and complex binding said salt with at least one complex former comprising functional groups in the form of OH or $NR_3$, wherein R=H or alkyl;

adding hard constituent powder to the solution;

forming a powder mixture by evaporating the solvent;

heat treating the powder mixture in an atmosphere until the hard constituent powder is coated with said at least one metal, said atmosphere being selected from the group consisting of inert atmospheres, reducing atmospheres and mixtures thereof.

2. The method of making the metal composite material of claim 1 wherein said solution further includes adding a soluble carbon source to the solution.

3. The method of making a metal composite material of claim 1 wherein said solution further includes at least one salt of at least one iron group metal containing organic groups.

4. The method of making the metal composite material of claim 1 wherein the solvent is selected from the group consisting of methanol, ethanol, acrylonitrile, triethanolamine, dimethylformamide, dimethylsulfoxide and mixtures thereof.

5. The method of making the metal composite material of claim 1 wherein the solvent comprises a mixture of methanol and ethanol, or water and glycol.

6. The method of making the metal composite material of claim 1 wherein sugar is added to the solution.

7. The method of making the metal composite material of claim 1 wherein carbon is included in the coating.

8. The method of making the metal composite material of claim 1 wherein the coated powder is pressed into a shaped body and the shaped body is sintered.

9. The method of making the metal composite material of claim 1 wherein the atmosphere is selected from the group consisting of nitrogen, hydrogen, argon, ammonia, carbon monoxide, carbon dioxide and mixtures thereof.

10. The method of making the metal composite material of claim 1 wherein the coated powder is mixed with one or more of coated hard constituent powder, binder phase metal, carbon and uncoated hard constituent powder mixture being further compacted and sintered.

11. The method of making the metal composite material of claim 1 wherein the solution is heated prior to adding said hard constituent powder.

12. The method of making the metal composite material of claim 1 wherein the solution is stirred prior to adding said hard constituent powder.

13. The method of making the metal composite material of claim 3 wherein carbon is incorporated in the coating during the step of forming the coating.

14. The method of making the metal composite material of claim 1 wherein the hard constituent powder comprises WC, (TiW)C, (Ta,Nb)C, (Ti,Ta,Nb)C, (Ti,W)C, TiC, TaC, NbC, VC, $Cr_3C_2$.

15. The method of making the metal composite material of claim 1 wherein said solution further includes kneading the powder mixture prior to the step of forming the coating.

16. The method of making the metal composite material of claim 1 wherein the powder is heated to 400° to 1100° C. during the step of forming the coating.

* * * * *